US005170016A

United States Patent [19]

Liu et al.

[11] Patent Number: 5,170,016

[45] Date of Patent: Dec. 8, 1992

[54] PLASTIC OUTER SHELL FOR A COMPUTER CONNECTOR

[75] Inventors: Yun-Yu Liu, Taipei; Ming-Shing Laiw, Yun Lin, both of Taiwan

[73] Assignee: Pan-International Industrial Corp., Hsin-Tien-Taipei, Taiwan

[21] Appl. No.: 731,660

[22] Filed: Jul. 17, 1991

[51] Int. Cl.[5] ..... H01B 17/16

[52] U.S. Cl. ..... 174/138 R; 174/135; 174/74 A; D13/133; D13/138

[58] Field of Search ..... 174/138 R, 135-138 F, 174/35 C, 46, 10, 749, 76, 87, 137 R; 439/445, 446, 447; D13/133, 137, 138, 139, 141-147

[56] References Cited

U.S. PATENT DOCUMENTS 3,113,998 12/1963 Laine ..... 174/138 R 4,634,208 1/1987 Hall et al. ..... 439/610

*Primary Examiner*—Leo P. Picard
*Assistant Examiner*—Hyung S. Sough
*Attorney, Agent, or Firm*—Jacobson, Price, Holman & Stern

[57] ABSTRACT

A plastic outer shell for a DIN/MINI DIN computer connector has a hollow, elongated rear end extending from the body thereof at one end, the hollow, elongated rear end made from a flexible plastic material and integrally formed of a plurality of spaced, straight ribs in longitudinal direction and a plurality of spaced, curved ribs in transverse direction, the spaced, curved ribs permitting the cross sectional area defined in the hollow, elongated rear end to be expanded for holding cables of different outer diameter.

1 Claim, 2 Drawing Sheets

PLASTIC OUTER SHELL FOR A COMPUTER CONNECTOR

BACKGROUND OF THE INVENTION

The present invention relates to a plastic outer shell for a computer connector and relates more particularly to such a plastic outer shell for a computer connector which has a cylindrical rear end that can be expanded in transverse (radial) direction for holding cables of different specification (outer diameter).

A computer connector is generally covered inside a plastic outer shell which is designed for the purpose of comfortable and positive grip and for holding a connector constantly in connection with the connected cable. The plastic outer shell generally has a cylindrical rear end for holding the connected cable in position. As illustrated in FIG. 1, the cylindrical rear end of the conventional structure of plastic outer shell generally has a plurality of evenly spaced grooves (A) transversely made on the outer wall thereof by which the cylindrical rear end can be flexibly bent to deform. Because the cross sectional area of the caliber (B) of the cylindrical rear end is not be expandable, a plastic outer shell for the cables of one specification (outer diameter) may not be suitable for the cables of different specification. Therefore, a variety of outer shells are required for making different computer connectors.

SUMMARY OF THE INVENTION

The present invention has been accomplished to eliminate the aforesaid problem. It is therefore the main object of the present invention to provide a plastic outer shell for a computer connector, the cylindrical rear end of which for holding cable is flexible and can be expanded in radial direction to hold any of a variety of cables.

DETAILED DESCRIPTION OF THE PREFERRED EMBODIMENTS

Figure 1:
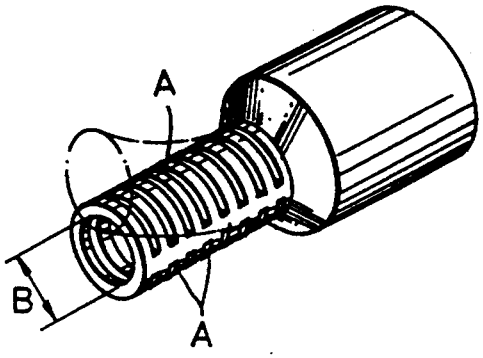
FIG. 1 (PRIOR ART)
FIG. 1 is a perspective view of a plastic outer shell for a computer connector as constructed according to the prior art.
Figure 2:
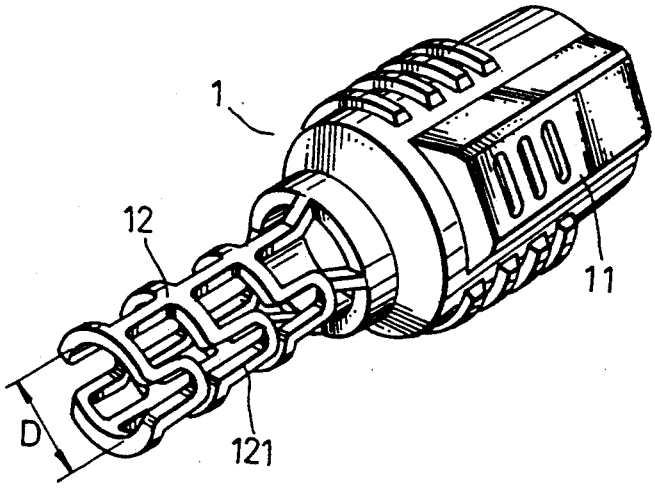
FIG. 2 is a perspective view of a plastic outer shell for a computer connector as constructed according to the present invention.

Referring to FIG. 2, a plastic outer shell for a computer connector as constructed in accordance with the present invention has a cylindrical rear end 12 extending from the body 11 thereof for holding cable. The cylindrical rear end 12 is made from a flexible plastic material and comprised of a plurality of ribs longitudinally transversely connected one another, wherein the ribs 121 which are evenly spaced from one another and disposed in transverse direction are each formed in a curved shape; the ribs 121 which are evenly spaced from one another and disposed in longitudinal direction are each formed in a straight line.

Figure 3:
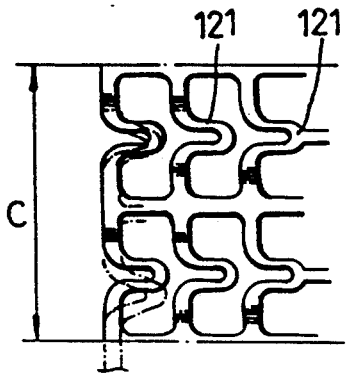
FIG. 3 is a partly plan view of the cylindrical rear end of the plastic outer shell taken on FIG. 2 in an enlarged scale.

Referring to FIG. 3, each rib 121 which is disposed in transverse direction has a substantially U-shaped middle part with adjacent limbs which can be opened out and permits the length C of the circumference to be stretched. When the length C of the circumference of the cylindrical rear end is stretched radially, the cross sectional area of the inner diameter D is expanded for holding a cable of bigger outer diameter.

Figure 4:
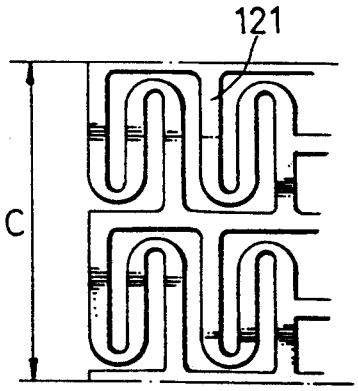
FIG. 4 illustrates an alternate form of the present invention.

Referring to FIG. 4, therein illustrated is an alternate form of the present invention, in which the ribs 121 which are disposed in transverse direction are each formed of interconnecting U-shaped parts forming a S-shaped structure. By means of this arrangement, the cylindrical rear end of the plastic outer shell can also be expanded in radial direction for holding cable of different specification.

As indicated, the present invention may have various embodiments. Accordingly, the aforesaid embodiments are intended for purpose of illustration and not as limitation.

What is claimed is:

1. A plastic outer shell for a DIN/MINI DIN computer connector comprising:

a hollow elongated rear end extending from a body thereof at one end of the body for holding a cable, characterized in that said hollow elongated rear end is integrally formed of a plurality of spaced, straight ribs extending in a longitudinal direction and a plurality of spaced, curved ribs extending in a transverse direction, said spaced, curved ribs each having a substantially U-shaped part with adjacent limbs which can be opened out permitting the cross sectional area defined in said hollow elongated rear end to be expanded.

* * * * *